US005128594A

United States Patent [19]

Watanabe et al.

[11] Patent Number: 5,128,594

[45] Date of Patent: Jul. 7, 1992

[54] ILLUMINATION CONTROL APPARATUS

[75] Inventors: Yuichi Watanabe, Yokosuka; Masayuki Morita; Kyoji Yamazaki, both of Yokohama, all of Japan

[73] Assignee: Toshiba Lighting & Technology Corporation, Tokyo, Japan

[21] Appl. No.: 662,039

[22] Filed: Feb. 28, 1991

[30] Foreign Application Priority Data

Feb. 28, 1990 [JP] Japan ..... 2-47457
Mar. 30, 1990 [JP] Japan ..... 2-83584

[51] Int. Cl.[5] ..... H05B 41/36

[52] U.S. Cl. ..... 315/294; 315/297; 315/315; 315/DIG. 4

[58] Field of Search ..... 315/294, 291, 295, 297, 315/299, 307, 315, DIG. 4, 195, 316; 307/31, 40

[56] References Cited

U.S. PATENT DOCUMENTS 4,388,567 6/1983 Yamazaki et al. ..... 315/295 X
4,889,999 12/1989 Rowen ..... 315/294 X

*Primary Examiner*—Eugene R. LaRoche
*Assistant Examiner*—Ali Neyzari
*Attorney, Agent, or Firm*—Cushman, Darby & Cushman

[57] ABSTRACT

An illumination control apparatus is constituted by a main operation panel for performing dimming control of a plurality of different lighting units, a plurality of dimming terminals for receiving dimming data from the main operation panel, and a pair of transmission lines for connecting the plurality of dimming terminals to the main operation panel. In the dimming terminals, the types of different lighting unit are selected in accordance with the dimming data from the main operation panel. Upon selection of the types, the dimming characteristics of the lighting units are converted into desired dimming characteristics, respectively. Dimming signals corresponding to the lighting units are formed on the basis of the dimming characteristics obtained by the conversion. The formed dimming signals are output to the lighting units. With this operation, dimming outputs from the plurality of different lighting units are controlled in accordance with the dimming data from the main operation panel.

13 Claims, 10 Drawing Sheets

ILLUMINATION CONTROL APPARATUS

BACKGROUND OF THE INVENTION

1. Field of the Invention

The present invention relates to an illumination control apparatus and, more particularly, to an illumination control apparatus responsive to illumination loads having different dimming characteristics.

2. Description of the Related Art

As a conventional illumination control apparatus used in a general office building or the like, a control apparatus for performing illumination control with the same dimming characteristics is known even if, for example, a lighting unit with a louver and a lighting unit without a louver, or a lighting unit having high-output characteristics and a lighting unit having a normal output characteristics are used together. For this reason, if lighting units having different light output characteristics are used together, their brightness and dimming characteristics differ from each other. In this specification, a dimming characteristic means a degree of change of an optical output value obtained when a power supplied to an illumination load is changed from zero to a rated value.

In order to set uniform brightness among lighting units having different output characteristics, the present inventors have developed an illumination control apparatus constituted by a plurality of circuits having different dimming characteristics in correspondence with the different output characteristics. This illumination control apparatus is designed to select circuits corresponding to the types of illumination loads and selectively connect the circuits to the loads through selection jumpers, thus setting dimming characteristics corresponding to the types of illumination loads.

If, however, the currently used illumination loads are replaced with illumination loads having different dimming characteristics, or louvers are attached or detached to or from the currently used illumination loads with a change in interior layout or the like, the overall control apparatus or its dimming characteristics must be changed. This requires a cumbersome operation.

In a system in which illumination loads connected to a dimming terminal controlled by a main operation panel is subjected to dimming control by means of a dimming level setter such as a hand dimming switch, dimming control of each illumination load is performed in proportion to dimming data corresponding to an operation amount of the dimming level setter fetched by the dimming terminal.

According to human visual sensitivity, in a dark place, a slight change in brightness is felt as a large change in brightness. In contrast to this, in a bright place, a slight change in brightness is not felt much.

If, therefore, dimming control of each illumination load is performed in proportion to an operation amount of a dimming level setter, as in the above-mentioned illumination control apparatus, the level setter must be finely operated to obtain dimming control adapted to human visual sensitivity to brightness. This also poses problems in terms of operability.

SUMMARY OF THE INVENTION

It is an object of the present invention to provide an illumination control apparatus which has illumination loads having different dimming characteristics, which can control the illumination loads to have uniform brightness, and which easily provides dimming control adapted to human visual sensitivity to brightness.

According to an aspect of the present invention, there is provided an illumination control apparatus comprising dimming control means for performing dimming control of a plurality of different illumination loads to be turned on, a pair of transmission lines, each having one end connected to the illumination control means, and a plurality of dimming terminals, connected to the other end of each of the transmission lines, for controlling dimming outputs of the plurality of different illumination loads in accordance with dimming data from the dimming control means, the terminal control means including selection sections for selecting types of the plurality of different illumination loads in accordance with the dimming data from the dimming control means, a plurality of dimming characteristic converting sections for respectively converting dimming characteristics of the plurality of illumination loads selected by the selecting sections into desired dimming characteristics, dimming signal forming sections for forming dimming signals corresponding to the illumination loads on the basis of the dimming characteristics converted by the dimming characteristic converting sections, and dimming output circuits for respectively outputting the dimming signals formed by the dimming signal forming sections to the illumination loads.

According to another aspect of the present invention, there is provided a dimming terminal for controlling dimming outputs of a plurality of different illumination loads to be turned on, comprising selecting means for selecting types of the plurality of different illumination loads, a plurality of dimming characteristic converting means for respectively converting dimming characteristics of the plurality of different illumination loads selected by the selecting means into desired dimming characteristics, dimming signal forming means for forming dimming signals corresponding to the plurality of different illumination loads on the basis of the dimming characteristics converted by the dimming characteristic converting means, and dimming output circuits for outputting the dimming signals formed by the dimming signal forming means to the illumination loads.

According to still another aspect of the present invention, there is provided an illumination control apparatus comprising dimming control means for performing dimming control of a plurality of different illumination loads to be turned on, a pair of transmission lines, each having one end connected to the dimming control means, and a plurality of dimming terminals, connected to the other end of each of the transmission lines, for controlling dimming outputs of the plurality of different illumination loads in accordance with dimming data from the dimming control means, the terminal control means including dimming data input sections for fetching the dimming data of the plurality of different illumination loads, dimming signal forming sections for forming conversion components for increasing rates of change of illuminance of the illumination loads with an increase in dimming set amount toward a brighter side, as dimming signals which are actually output with respect to changes in operation amount of operating sections for operating the dimming set amounts upon every change in operation amount, on the basis of the dimming data fetched by the dimming data input sections, and dimming output sections for outputting the dimming signals formed by the dimming signal forming sections to the illumination loads.

According to further aspect of the present invention, there is provided a dimming terminal comprising dimming data input means for fetching dimming data of a plurality of different illumination loads to be turned on, dimming signal forming means for forming conversion components for increasing rates of change of illuminance of the illumination loads with an increase in dimming set amount toward a brighter side, as dimming signals which are actually output with respect to changes in operation amount of operating sections for operating the dimming set amounts upon every change in operation amount, on the basis of the dimming data fetched by the dimming data input means, and dimming output means for outputting the dimming signals formed by the dimming signal forming means to the illumination loads.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Embodiments of the present invention will be described below with reference to the accompanying drawings.

Figure 1:
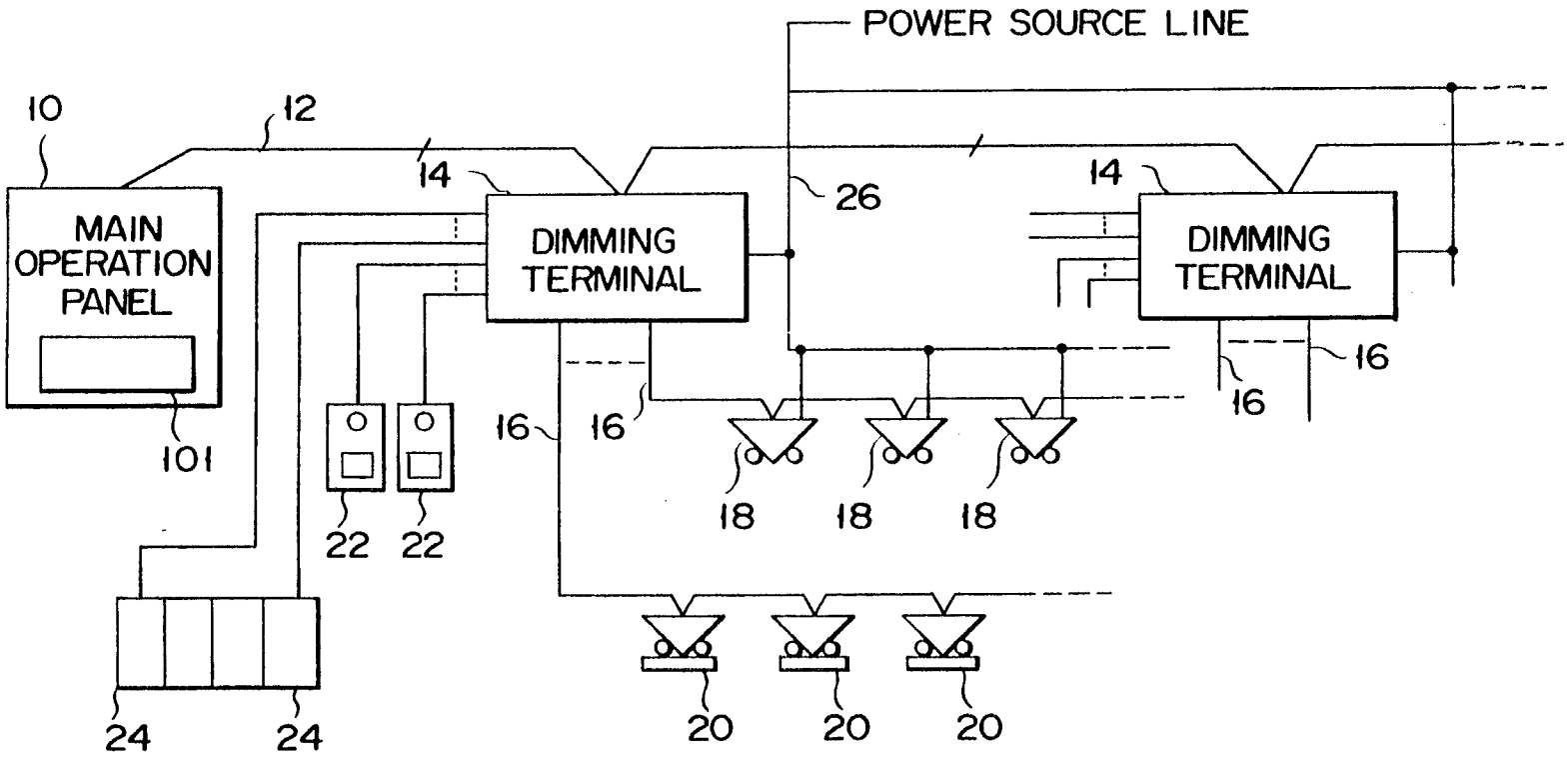
FIG. 1 is a block diagram showing an arrangement of a remote illumination control system to which an illumination control apparatus of the present invention is applied.

FIG. 1 shows an arrangement of a remote illumination control apparatus to which an illumination control apparatus of the present invention is applied. Referring to FIG. 1, a plurality of dimming terminals 14 as dimming controllers, which have, for example, a function of designating a terminal (to be described later) and a control function by an operation switch or a time schedule, are connected to a main operation panel 10 functioning as dimming control means having a display section 101 so as to control the respective systems through a two-wire transmission line 12. A plurality of lighting units 18 and 20 as illumination loads are connected to these dimming terminals 14 through a pair of dimming signal lines 16. The dimming terminals 14 are arranged in the lighting units 18, 20 of channels as dimming output circuits. Of these lighting units, the lighting units 20 have louvers (to be described later) attached thereto.

In addition, dimming level setters 22 and type discriminating units 24 are connected to the dimming terminals 14. The dimming level setters 22 serve to switch the dimming levels of the lighting units 18 and 20. The type discriminating units 24 serve to identify, e.g., the types of ballasts so as to allow selection of dimming characteristics in accordance with the dimming characteristics of the lighting units 18 and 20. The dimming level setters 22 are arranged to correspond to the dimming signal lines 16 and are constituted by, e.g., hand dimming switches or hand dimming volumes. Commercial alternating current power (AC power) is supplied to the respective dimming terminals 14 and lighting units 18 through a power source line 26.

Figure 2:
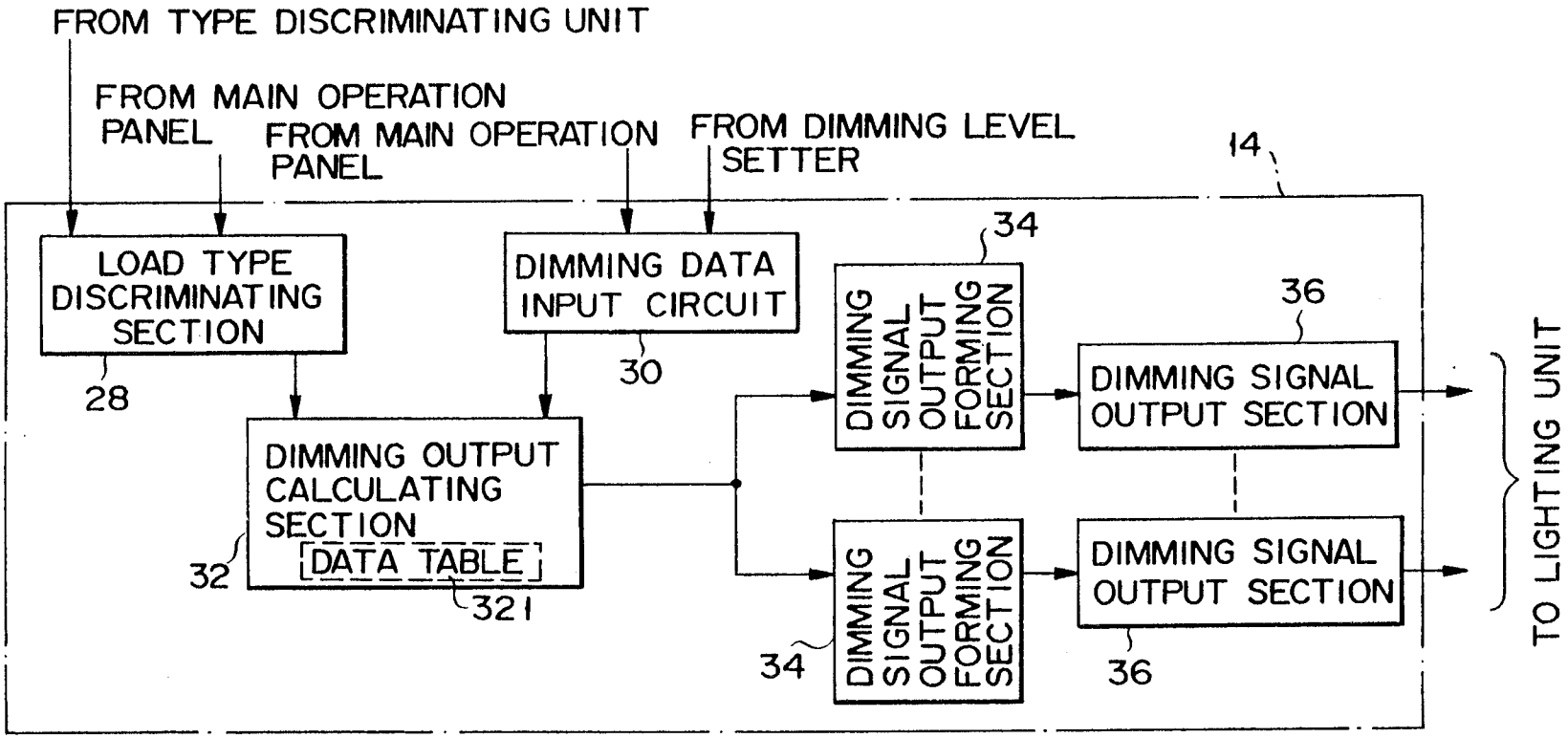
FIG. 2 is a block diagram showing a detailed arrangement of a dimming terminal in FIG. 1.

FIG. 2 shows a detailed arrangement of each dimming terminal 14. The dimming terminal 14 comprises a load type discriminating unit 28, a dimming data input section 30, a dimming output calculating section 32, dimming signal output forming sections 34, and dimming signal output sections 36. The load type discriminating unit 28 is a selecting means for selecting load type data on the basis of a signal output from the type discriminating unit 24 or a signal output from the main operation panel 10. The dimming data input section 30 receives dimming level correction data based on a deterioration in quality over time or dimming level data set by the main operation panel 10, and one or both of dimming level data set by the dimming level setter 22. Data from the dimming data input section 30 and the load type discriminating unit 28 are operated by the dimming output calculating section 32 to obtain a dimming output. Alternatively, the dimming output calculating section 32 may include a plurality of data tables 321 in, e.g., a ROM or a RAM, in which dimming characteristics of the plurality of lighting units 18 and 20 are set in accordance with data input to the dimming data input section 30 so that a dimming output is selected from the data tables 321 on the basis of dimming characteristic data selected by the load type discriminating section 28. That is, the dimming output calculating section 32 serves as a means for converting dimming characteristics.

The dimming signal output forming section 34 forms a dimming signal in accordance with the data from the dimming output calculating section 32. Each dimming signal formed in this manner is output to a corresponding dimming signal output section 36 so as to output each signal to a corresponding one of the lighting units 18 and 20 in units of channels.

Figure 3:
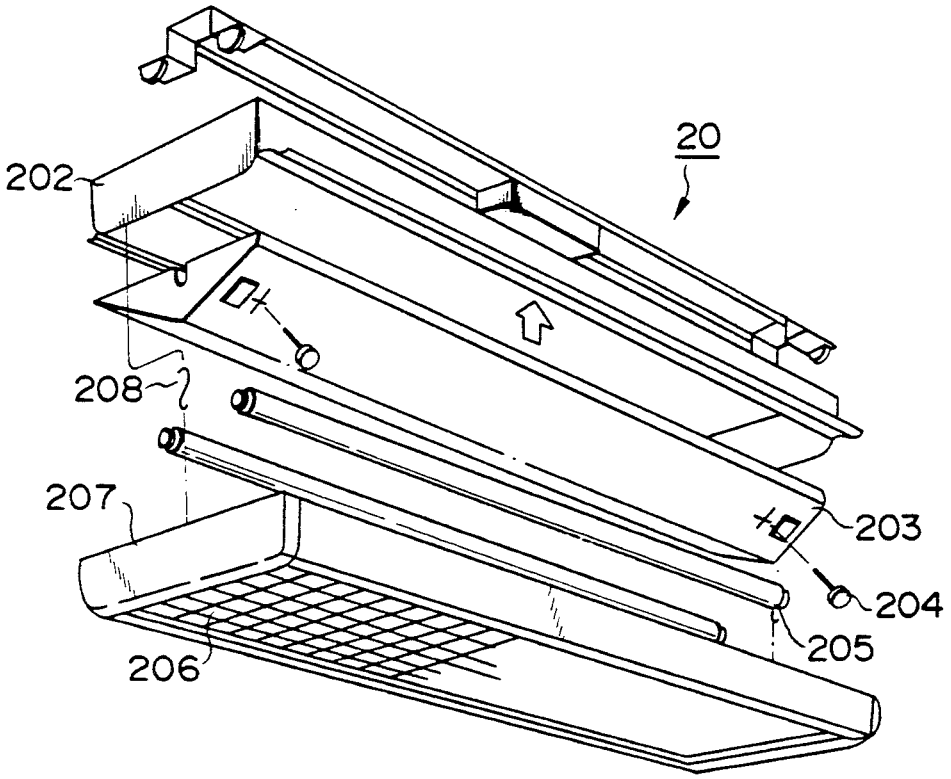
FIG. 3 is an exploded perspective view showing a lighting unit with a louver as an illumination load in FIG. 1.

Each lighting unit 20 described above has an arrangement shown in, e.g., FIG. 3. A frame 202 is attached to a main body 201 to cover it. A reflector 203 is housed in the frame 202 and is fixed thereto by face screws (set screws) 204 and the like. Lamps 205 are attached to a surface of the reflector 203. A frame 207 having a louver 206 attached therein is suspended from the frame 202 through cords 208 and the like, thus constituting a lighting unit with a louver. Note that a lighting unit such as a normal fluorescent lamp is used as the lighting unit 18 without a louver. Such a lighting unit has an arrangement equivalent to that of the lighting unit 20 shown in, e.g., FIG. 3 from which the frame 202, the louver 206, the frame 207, and the cords 208 are removed. In this embodiment, the louver 206 is attached to the lighting unit 20 to change its brightness. However, the present invention is not limited to this arrangement. For example, a prism or the like may be attached in place of the louver 206.

An operation of this embodiment will be described below.

Figure 4:
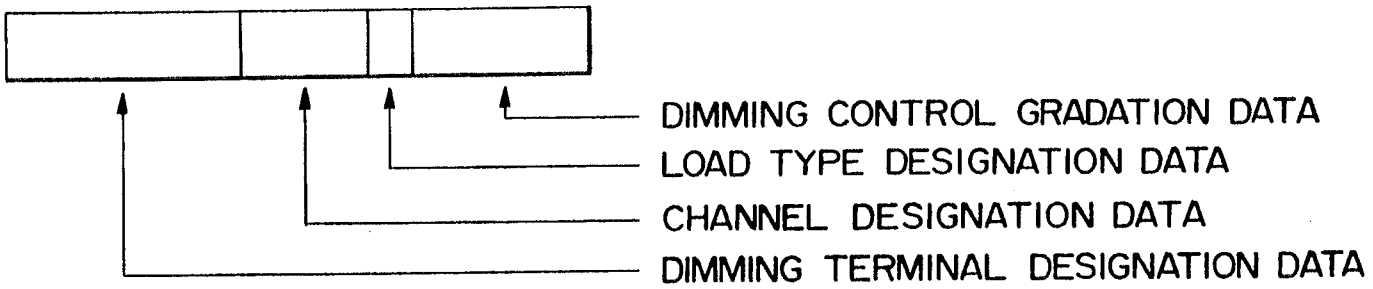
FIG. 4 is a view showing a format of transmission control data to be transmitted to a dimming terminal in FIG. 3.
Figure 5:
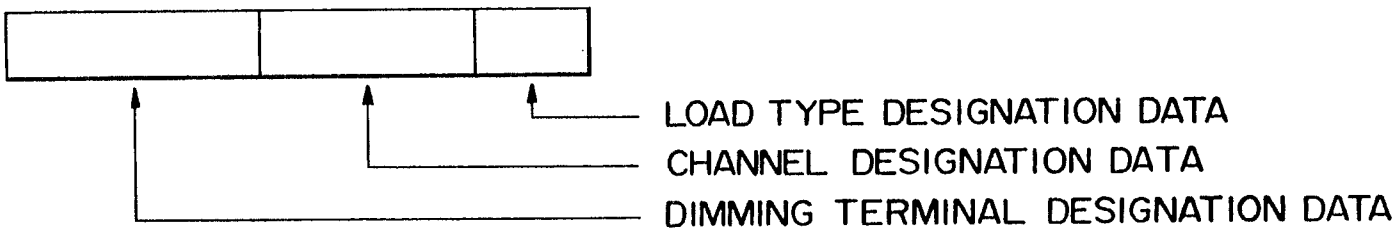
FIG. 5 is a view showing another format of transmission control data to be transmitted to the dimming terminal in FIG. 3.

Transmission control data is transmitted from the main operation panel 10 to the dimming terminal 14 through the transmission line 12 in accordance with a time schedule or the like. For example, as shown in FIG. 4, this transmission control data consists of four types of data, i.e., dimming terminal designation data for designating one of the dimming terminals 14, dimming channel designation data for designating one of the channels of the designated dimming terminal 14, load type designation data for designating the type of lighting units 18 or 20 discriminated by the type discriminating unit 24, and dimming control gradation data for setting the dimming gradation. Alternatively, as shown in FIG. 5, the transmission data may have a data format consisting of three types of data, which is equivalent to the data format in FIG. 4 from which the dimming control gradation data is removed.

Figure 6:
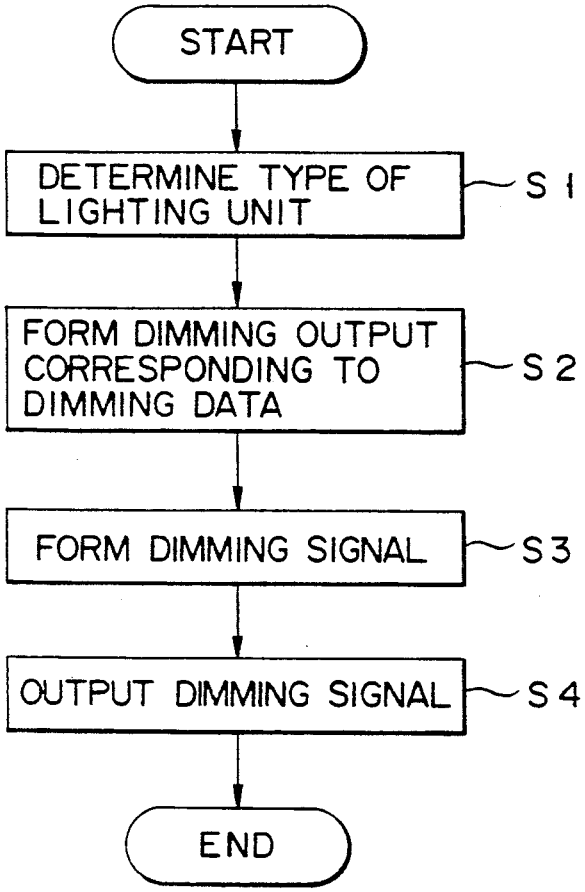
FIG. 6 is a flow chart for explaining an operation of a dimming controller in FIG. 1.

Upon reception of such transmission control data transmitted from the main operation panel 10, the dimming terminal 14 performs a control operation in accordance with a flow chart in FIG. 6. More specifically, the type of lighting units 18 or 20 is determined by load type designation data (step S1). A dimming output is read from or calculated by one of the data tables 321 in the dimming output calculating section 32 in accordance with the determined type (step S2). Thereafter, a dimming signal is formed by the dimming signal output forming section 34 (step S3). The dimming signal is output from the dimming signal output section 36 (step S4).

Figure 7:
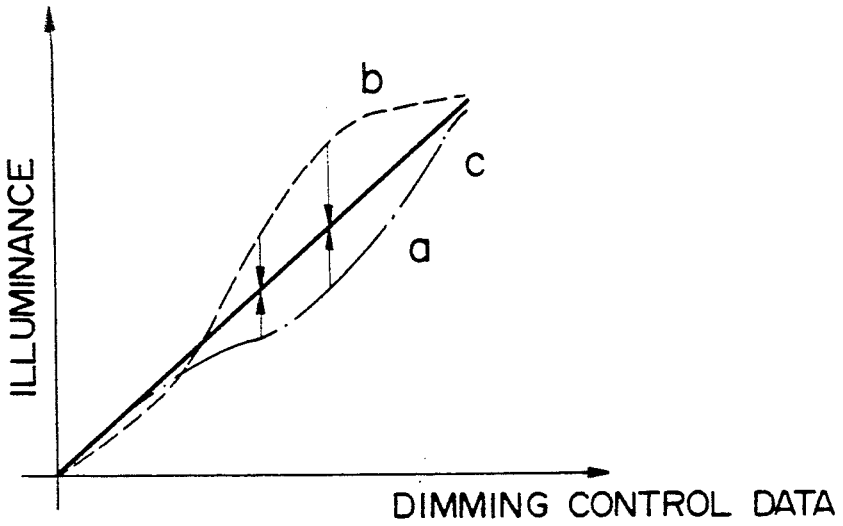
FIGS. 7 and 8 are graphs showing dimming characteristics obtained by the illumination control apparatus of the present invention.
Figure 8:
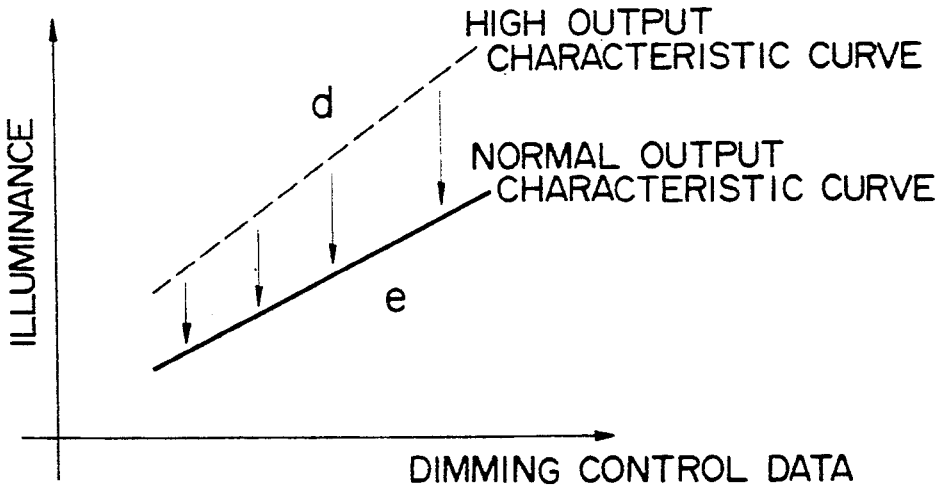

If dimming control data for the lighting units 18 and 20 differ from each other as in the above case, a lighting unit exhibiting a high-output characteristic curve a and a lighting unit exhibiting a normal output characteristic b are both controlled with substantially linear characteristics indicated by a reference curve c, as shown in, e.g., FIG. 7. Assuming that the lighting units 18 and 20 have different characteristics, the dimming characteristics of a lighting unit exhibiting a high-output characteristic curve d can be set to coincide with those of a lighting unit exhibiting normal output characteristic curve e. Therefore, these lighting units can have the same illuminance.

In the dimming terminal 14 shown in FIG. 2, the load type discriminating section 28 may be replaced with a switch as a selecting means for manually performing a switching operation in accordance with the dimming characteristics of the lighting units 18 and 20.

In addition, the data tables 321 in the dimming output calculating section 32 may be designed to store formulae for calculating data instead of storing data of the respective dimming characteristics.

Figure 9:
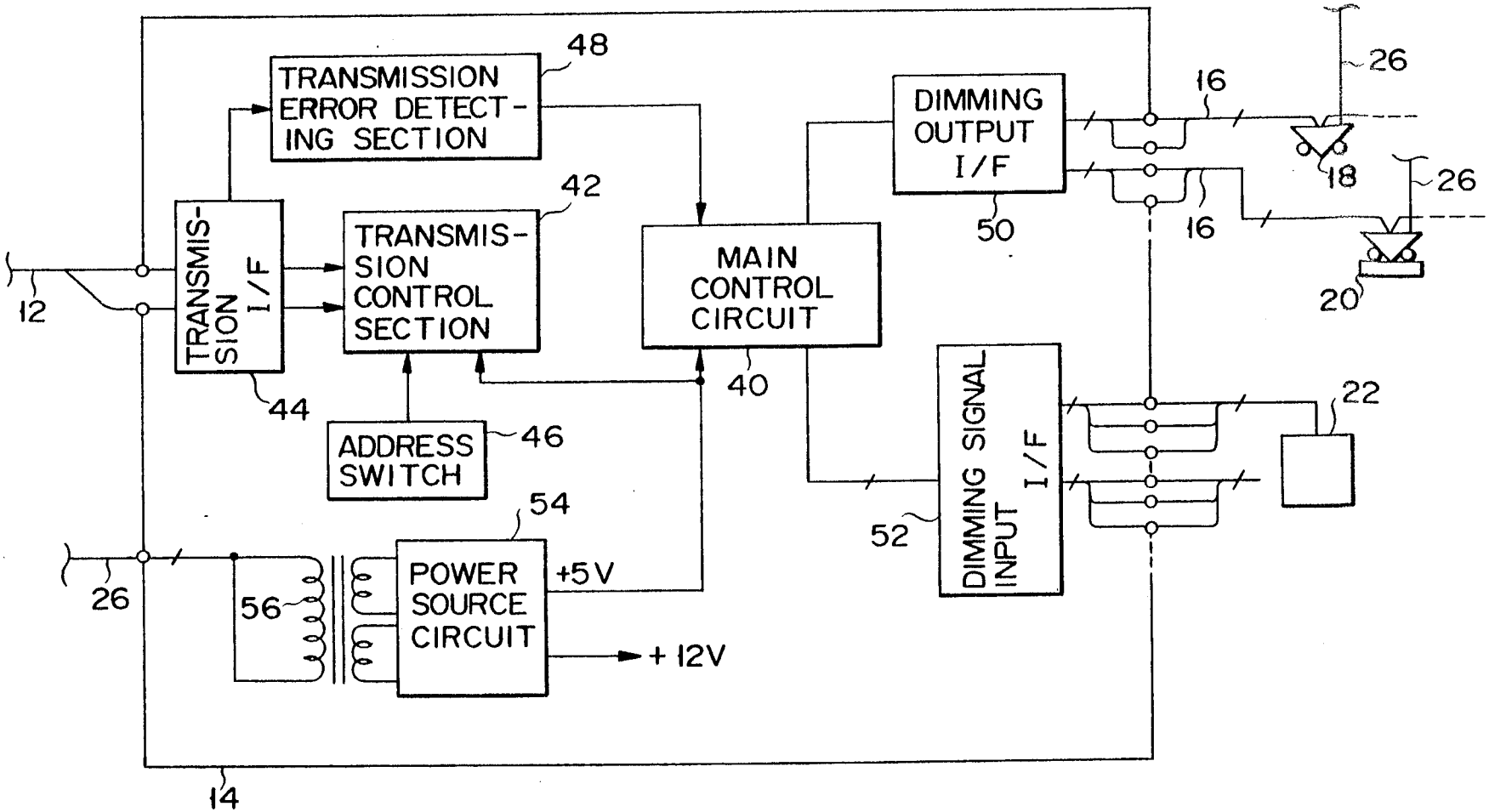
FIG. 9 is a block diagram showing the dimming terminal in FIG. 2 in more detail.

The dimming terminal in FIG. 2 will be described in more detail below. Referring to FIG. 9, a transmission control section 42 connected to a main control section 40 through a data bus serves to control transmission and reception of signals to and from the main operation panel 10 through the two-wire transmission line 12 connected to a transmission interface (transmission I/F) 44. The transmission control section 42 compares the address of the self terminal, which is set by an address switch 46, with an address designated by the main operation panel 10. If the two addresses coincide with each other, the transmission control section 42 fetches a signal from the main operation panel 10. Furthermore, in transmission, the transmission control section 42 transmits the signal to the main operation panel 10 with the address of the self terminal added.

A transmission error detecting section 48 detects a transmission error in the transmission I/F 44. When the transmission error detecting section 48 detects a transmission error and outputs a transmission error detection signal to the main control section 40, the main control section 40 starts a fail-safe function to turn on all the lighting units 18 and 20 through a dimming output interface (dimming I/F) 5 and the dimming signal lines 16.

The respective dimming level setters 22 are connected to a dimming signal input interface (dimming signal input I/F) 52. When dimming levels are set by these dimming level setters 22, dimming control data are fetched by the main control section 40 through the dimming signal input I/F 52. The main control section 40 performs processing, e.g., correction, of the dimming control data in relation to visual sensitivity to brightness (to be described later). Thereafter, the main control section 40 outputs pulse-width-modulated (PWM) dimming signals to the respective lighting units 18 and 20 through the dimming output I/F 50, thus performing dimming control.

AC power supplied to a transformer 56 through the power source line 26 is supplied to a power source circuit 54 after the power is transformed by the transformer 56. DC power generated by the power source circuit 54 is supplied to the respective circuits in the dimming terminal 14.

Correction processing in relation to human visual sensitivity to brightness, which is performed by the main control section 40, will be described below.

In this correction in relation to human visual sensitivity to brightness (to be referred to as visual sensitivity correction), the dimming amounts of the lighting units 18 and 20 are not changed in proportion to changes in operation amount of the dimming level setters 22. That is, in visual sensitivity correction, the actual dimming amounts of the lighting units 18 and 20 are exponentially increased in relation to the operation amounts of the dimming level setters 22 as the current dimming levels become higher, thereby responding to the visual sensitivity characteristics of a person, which vary depending on whether he or she is in a dark or bright place.

Figure 10:
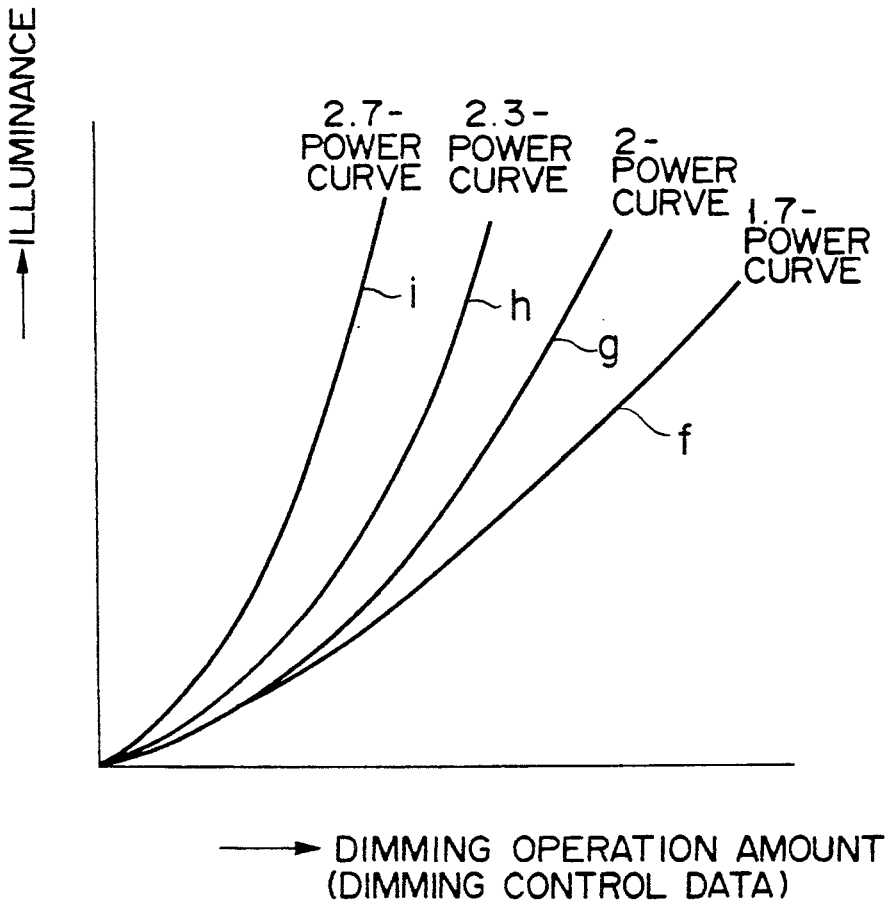
FIG. 10 is a graph showing characteristic curves for correction processing in relation to visual sensitivity to brightness.

FIG. 10 shows characteristic curves associated with the above-described visual sensitivity correction. Referring to FIG. 10, the operation amount of the dimming level setter 22 is plotted along the axis of abscissa. If, for example, the setter 22 is a dimming switch, the operation amount corresponds to the number of times of depressing the switch to decrease or increase the dimming amount, or to the duration of depression of the switch. If the setter 22 is a dimming volume, the operation amount corresponds to the rotational angle of the volume. In addition, the illuminance of the lighting units 18 and 20 subjected to dimming control are plotted along the axis of ordinate. Characteristic curves f, g, h, and i respectively correspond to a 1.7-power curve, a 2-power curve, a 2.3-power curve, and a 2.7-power curve. Of the plurality of characteristic curves f, g, h, and i shown in FIG. 10, one characteristic curve to be used is determined in terms of, e.g., design in accordance with an environment in which the lighting units 18 and 20 are installed.

Only processing data of one correction curve which allows proper correction in accordance with an environment in which the lighting units 18 and 20 are installed may be provided to the main control section 40. Alternatively, processing data of a plurality of correction curves may be stored in a memory so that these correction curves can be selectively used.

Figure 11:
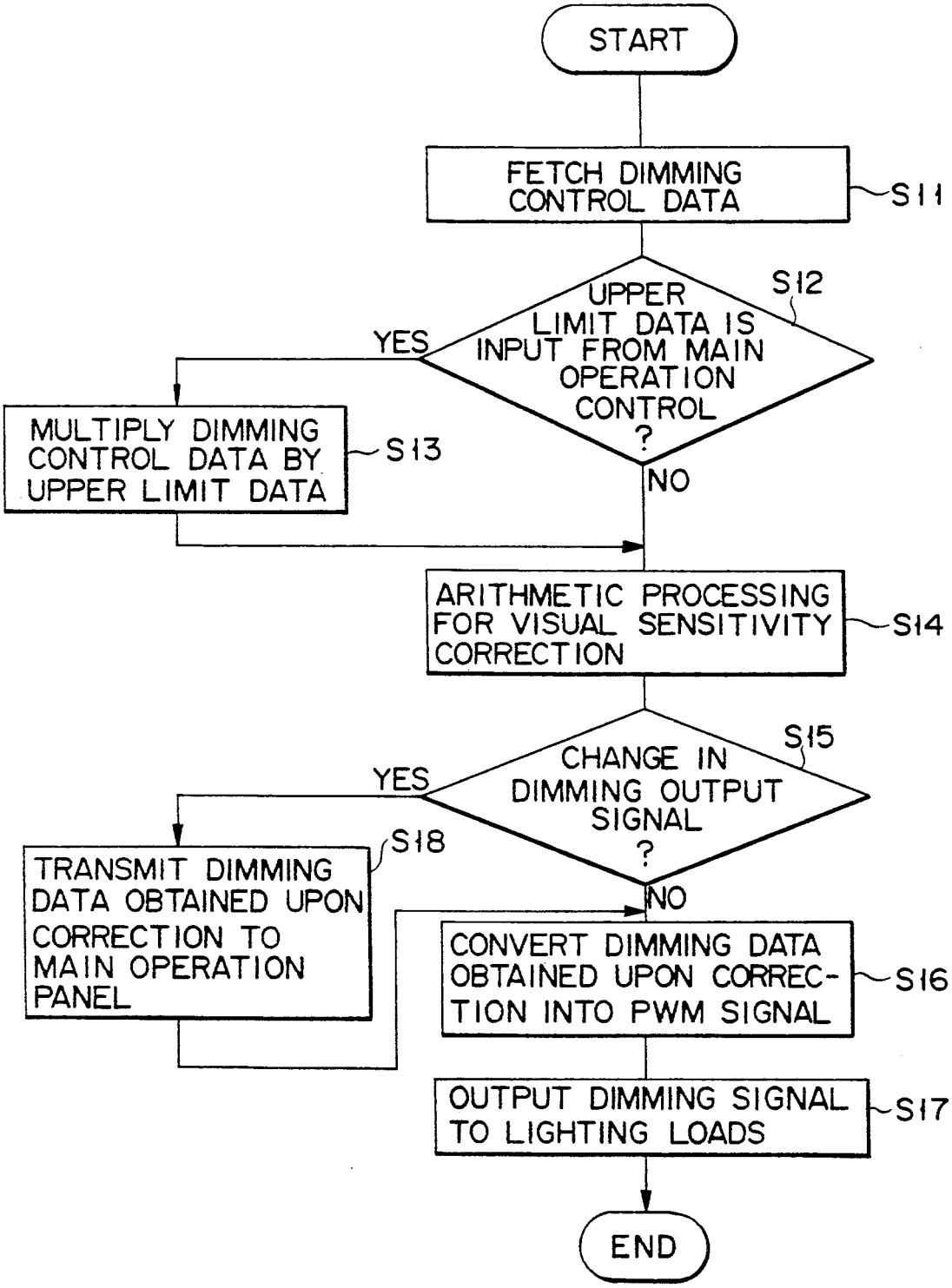
FIG. 11 is a flow chart for explaining an operation of a main control section in the dimming terminal in FIG. 9.

An operation of the main control section 40 in the dimming terminal 14 will be described below with reference to FIG. 11.

The dimming level setter 22 is operated first, and dimming control data corresponding to the operation amount is fetched through the dimming signal input I/F 52 (step S11). The main control section 40 then checks whether control data which determines the upper limit of a dimming amount is transmitted from the main operation panel 10 (step S12). If YES in step S12, the main control section 40 multiplies the dimming control data corresponding to the operation amount of the dimming level setter 22 by the control data from the main control panel 10 (step S13). In contrast to this, if NO in step S12, the main control section 40 performs arithmetic processing to perform visual sensitivity correction on the basis of a correction characteristic curve corresponding to the dimming control data (step S14). This arithmetic processing can be performed by a method of formula calculation, or by a method of using a data table which stores data obtained upon visual sensitivity correction and corresponding to the operation amount (dimming control data) of the dimming level setter 22.

When the dimming data corrected so as to adapt to visual sensitivity is prepared by the arithmetic processing, the main control section 40 checks whether there is a change in dimming output signal (step S15). If NO in step S15, a timing signal corresponding to the dimming data upon correction is output to the dimming output I/F 50. The dimming output I/F 50 converts the input timing signal into a pulse-width-modulated signal (PWM signal) (step S16). Subsequently, the PWM dimming signal is transmitted to the lighting units 18 and 20 through the dimming signal lines 16 (step S17). With this operation, dimming control of each of the lighting units 18 and 20 is performed with a dimming amount obtained by performing visual sensitivity correction. Note that the timing signal may be the PWM signal, and the dimming output I/F 50 may output the input PWM signal upon amplification thereof.

If YES in step S15, the main control section 40 transmits the dimming output signal, as the final dimming output data obtained by correction, to the transmission control section 42, and subsequently transmits it to the main operation panel 10 through the transmission I/F 44 and the 2-wire transmission line 12 (step S18). With this operation, the current dimming output level of the terminal side can be constantly detected by the main operation panel 10. In addition, the current dimming output level on the terminal side can be monitored through the display section 101 of the main operation panel 10.

As described above, since arithmetic processing for visual sensitivity correction is performed by the main control section 40, the processing load of the main operation panel 10 can be reduced as compared with a case wherein such arithmetic processing is performed by the main operation panel 10. Thereafter, the processes in steps S16 and S17 are performed in sequence.

Arithmetic processing will be described below, which is performed by the main control section 40 on the basis of data, transmitted from the main operation panel 10, for determining the upper limit of a dimming control amount.

As described above, when control data for determining the upper limit of a dimming amount is transmitted from the main operation panel 10, the main control section 40 performs arithmetic processing (multiplication), i.e., multiplying dimming control data corresponding to the operation amount of the dimming level setter 22 by the control data transmitted from the main operation panel 10. Assume that dimming control of each of the lighting units 18 and 20 can be performed by the dimming terminal 14 in a range of 0 to 100%. In this case, if, for example, control data for determining 70% as the upper limit of a dimming range is transmitted from the main operation panel 10, even if the setter 22 performs a dimming operation from 0 to 100%, a corresponding illumination load is dimmed in a range of only 0 to 70%.

In this manner, the dimming control data obtained upon multiplication of the upper limit of the dimming amount is subsequently processed in accordance with steps S14 to S18.

Transmission of control data for determining the upper limit of a dimming range from the main operation panel 10 to the dimming terminal 14 allows easy dimming control of each of the lighting units 18 and 20 within a proper illuminance range, thus improving the apparatus in terms of operability and cost.

Control data for determining the upper limit of a dimming range, which is transmitted to the dimming terminal 14, may be updated by a time schedule or the like in the daytime and in the nighttime, or may be updated depending on how long each of the lighting units 18 and 20 is used, or before and after cleaning.

In a conventional system, even if dimming data of a lighting unit is transmitted to a dimming terminal on the basis of dimming data from a main operation panel or from a setter, once the setter is operated, it is difficult to restore a proper illuminance on the setter side because priority is given to the latest operation. With the above-described operation, however, the present invention can solve such a problem.

An arrangement of another remote illumination control system to which the present invention is applied will be described below with reference to FIG. 12.

Figure 12:
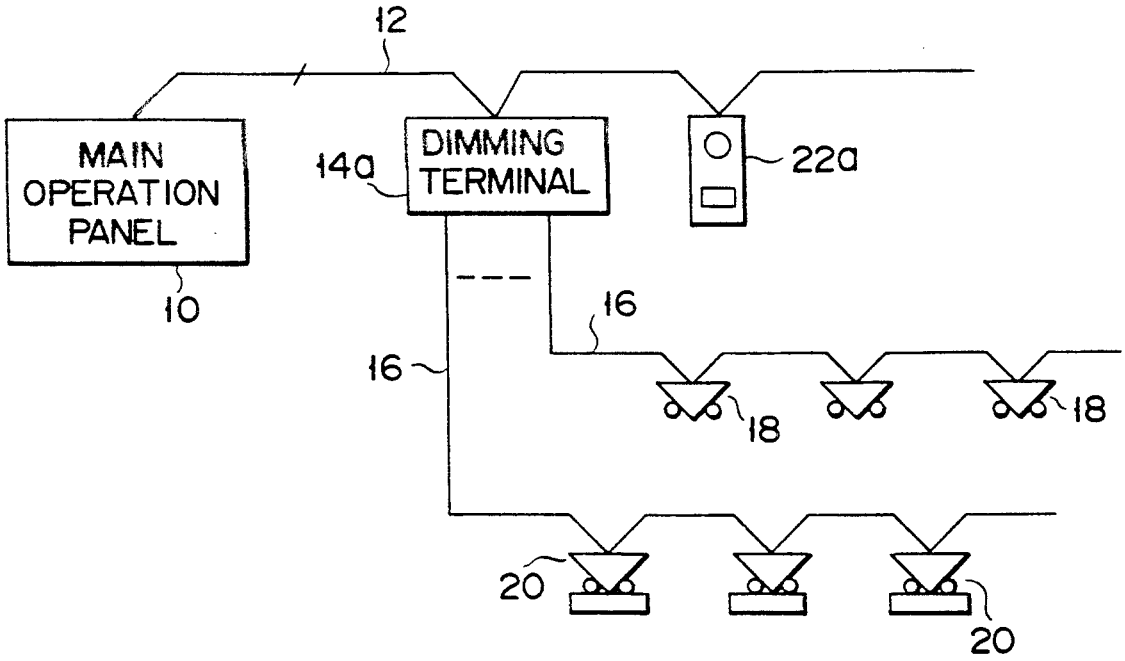
FIG. 12 is a block diagram showing an arrangement of another remote illumination control system to which the illumination control apparatus of the present invention is applied.

In the system shown in FIG. 12, a dimming terminal 14*a* and a dimming level setter 22*a* are connected to a main operation panel 10 through a two-wire transmission line 2. Dimming data transmitted from the dimming level setter 22*a* to the main operation panel 10 is transmitted to the dimming terminal 14*a*. The dimming terminal 14*a* then forms dimming data by performing visual sensitivity correction.

The dimming data obtained by visual sensitivity correction is converted into a PWM signal and is subsequently output to lighting units 18 and 20 as illumination loads through dimming signal lines 16. As a result, dimming control of the lighting units 18 and 20 is performed.

Figure 13:
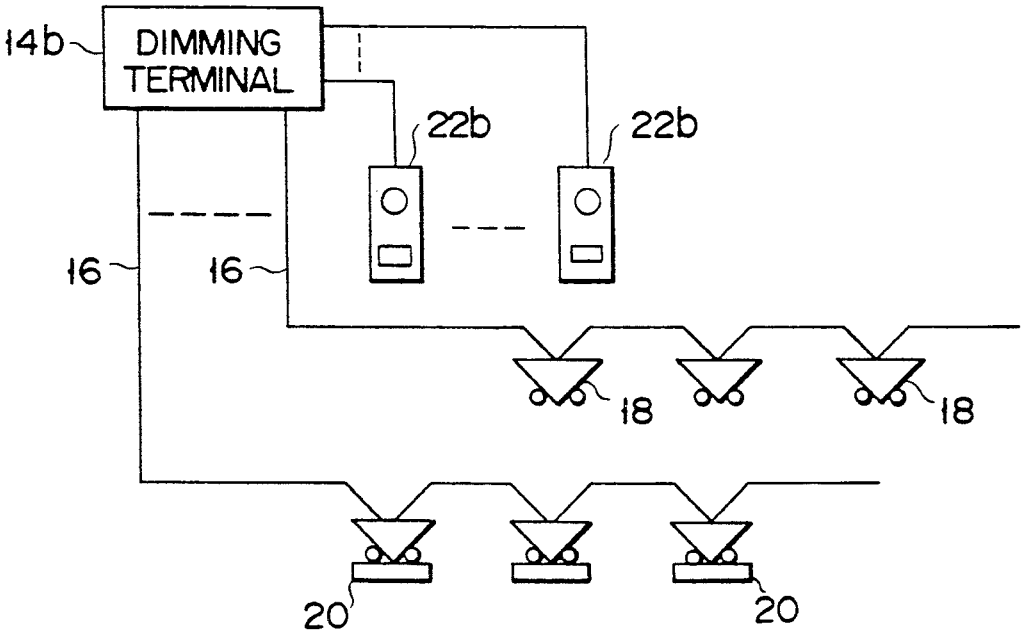
FIG. 13 is a block diagram showing still another remote illumination control system to which the illumination control apparatus of the present invention is applied.

FIG. 13 shows still another remote illumination control system to which the present invention is applied. Referring to FIG. 13, a dimming terminal 14*b* is not controlled by a main operation panel (not shown). A dimming level setter 22*b* is connected to the dimming terminal 14*b*. In addition, lighting units 18 and 20 are connected to the dimming terminal 14*b* through dimming signal lines 16. In this case, visual sensitivity correction is performed by the dimming terminal 14*b*.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An illumination control apparatus comprising:

dimming control means for performing dimming control of a plurality of different illumination loads to be turned on;

a pair of transmission lines, each having one end connected to said illumination control means; and a plurality of dimming terminals, connected to the other end of each of said transmission lines, for controlling dimming outputs of said plurality of different illumination loads in accordance with dimming data from said dimming control means, said terminal control means including selection sections for selecting types of said plurality of different illumination loads in accordance with the dimming data from said dimming control means, a plurality of dimming characteristic converting sections for respectively converting dimming characteristics of said plurality of illumination loads selected by said selecting sections into desired dimming characteristics, dimming signal forming sections for forming dimming signals corresponding to said illumination loads on the basis of the dimming characteristics converted by said dimming characteristic converting sections, and dimming output circuits for respectively outputting the dimming signals formed by said dimming signal forming sections to said illumination loads.

2. A system according to claim 1, wherein said dimming signal forming sections of said plurality of dimming terminals form different dimming signals in correspondence with said illumination loads.

3. A system according to claim 2, further comprising dimming level setting means for setting dimming levels of said illumination loads.

4. A system according to claim 2, further comprising type discriminating means for allowing selection of dimming characteristics in accordance with the dimming characteristics of said illumination loads.

5. A system according to claim 1, wherein some of said plurality of different illumination loads include light-shielding member for adjusting light outputs therefrom.

6. A system according to claim 1, wherein said dimming characteristic converting sections of said plurality of dimming terminals output dimming outputs of said illumination loads to said dimming signal forming sections on the basis of the dimming characteristics selected by said selecting sections.

7. A system according to claim 1, wherein said dimming characteristic converting sections of said plurality of dimming terminals include a plurality of data tables in which dimming characteristics of said plurality of illumination loads are set in advance.

8. A dimming terminal for controlling dimming outputs of a plurality of different illumination loads to be turned on, comprising:

selecting means for selecting types of said plurality of different illumination loads;

a plurality of dimming characteristics converting means for respectively converting dimming characteristics of said plurality of different illumination loads selected by said selecting means into desired dimming characteristics;

dimming signal forming means for forming dimming signals corresponding to said plurality of different illumination loads on the basis of the dimming characteristics converted by said dimming characteristic converting means; and dimming output circuits for outputting the dimming signals formed by said dimming signal forming means to said illumination loads, wherein a plurality of dimming signal forming means, each identical to said dimming signal forming means, are arranged to form a plurality of types of dimming signals corresponding to said plurality of different illumination loads, and wherein said dimming characteristic converting means outputs dimming outputs of said illumination loads to said dimming signal forming means on the basis of the dimming characteristics selected by said selecting means.

9. A dimming terminal for controlling dimming outputs of a plurality of different illumination loads to be turned on, comprising:

selecting means for selecting types of said plurality of different illumination loads;

a plurality of dimming characteristics converting means for respectively converting dimming characteristics of said plurality of different illumination loads selected by said selecting means into desired dimming characteristics;

dimming signal forming means for forming dimming signals corresponding to said plurality of different illumination loads on the basis of the dimming characteristics converted by said dimming characteristic converting means; and dimming output circuits for outputting the dimming signals formed by said dimming signal forming means to said illumination loads, wherein a plurality of dimming signal forming means, each identical to said dimming signal forming means, are arranged to form a plurality of types of dimming signals corresponding to said plurality of different illumination loads, and wherein said dimming characteristic converting means has a plurality of data tables in which dimming characteristics of said plurality of illumination loads are set in advance.

10. An illumination control apparatus comprising:

dimming control means for performing dimming control of a plurality of different illumination loads to be turned on;

a pair of transmission lines, each having one end connected to said dimming control means; and a plurality of dimming terminals, connected to the other end of each of said transmission lines, for controlling dimming outputs of said plurality of different illumination loads in accordance with dimming data from said dimming control means, said terminal control means including dimming data input sections for fetching the dimming data of said plurality of different illumination loads, dimming signal forming sections for forming conversion components for increasing rates of change of illuminance of said illumination loads with an increase in dimming set amount toward a brighter side, as dimming signals which are actually output with respect to changes in operation amount of operating sections for operating the dimming set amounts upon every change in operation amount, on the basis of the dimming data fetched by said dimming data input sections, and dimming output sections for outputting the dimming signals formed by said dimming signal forming sections to said illumination loads.

11. A system according to claim 10, wherein said dimming signal forming sections of said plurality of dimming terminals form different dimming signals in correspondence with said illumination loads.

12. A system according to claim 11, further comprising dimming level setting means for setting dimming levels of said illumination loads.

13. A system according to claim 10, wherein some of said plurality of different illumination loads include light-shielding member for adjusting light outputs therefrom.

* * * * *